US007090595B2

(12) United States Patent
Hazelton

(10) Patent No.: US 7,090,595 B2
(45) Date of Patent: Aug. 15, 2006

(54) DICTIONARY DAZZLE

(76) Inventor: Daniel H. Hazelton, 55 Nunan St., Charleston, SC (US) 29403

( * ) Notice: Subject to any disclaimer, the term of this patent is extended or adjusted under 35 U.S.C. 154(b) by 75 days.

(21) Appl. No.: 10/656,915

(22) Filed: Sep. 8, 2003

(65) Prior Publication Data

US 2004/0121860 A1 Jun. 24, 2004

Related U.S. Application Data

(63) Continuation-in-part of application No. 10/093,817, filed on Mar. 11, 2002, now abandoned.

(51) Int. Cl.
*A63B 67/00* (2006.01)

(52) U.S. Cl. ..... 473/415

(58) Field of Classification Search ..... 473/415, 473/470; 273/400; D21/362
See application file for complete search history.

(56) References Cited

U.S. PATENT DOCUMENTS

| | | | | |
|---|---|---|---|---|
| 2,130,820 | A * | 9/1938 | Trumbull | 473/470 |
| 4,482,157 | A * | 11/1984 | McNeil | 473/470 |
| 5,566,938 | A * | 10/1996 | MacDonald | 473/470 |
| 5,826,876 | A * | 10/1998 | Wagner | 273/244 |
| 6,059,673 | A * | 5/2000 | Mason | 473/478 |
| 6,117,031 | A * | 9/2000 | Malinauskas et al. | 473/570 |
| 6,161,833 | A * | 12/2000 | Gomez | 273/400 |
| 6,213,900 | B1 * | 4/2001 | Steyn et al. | 473/434 |
| 6,257,996 | B1 * | 7/2001 | Lukens | 473/415 |
| 6,296,581 | B1 * | 10/2001 | Sever | 473/422 |

OTHER PUBLICATIONS

Web Page, Cricket Field Dimensions, Apr. 10, 2001,www.stadiumturf.com/cricket_field_dimensions.com, 4 pages.*

* cited by examiner

*Primary Examiner*—Eugene Kim
*Assistant Examiner*—M. Chambers

(57) ABSTRACT

This patent application describes equipment used to play a contact or semi-contact game that is played on a field. The object of the game's for athletics to battle against one another to gain access into the equipment that is a mound and the device atop the mound called a horizontal, in order to follow expressed language of the horizontal that will allow a runner to quickly lift and flick a bar with their wrist, allowing an opportunity to score or to complete an after point scoring attempt. Taken together the actions precipitate the translocation of a ball that's necessary for scoring in other contact and semi-contact sports.

This patent application further discloses methods of playing a game two to five teams play on lined rectangular surfaces with side and end boundaries in or outdoors which expressed language printed below the horizontal or rotatable that's mounted atop the mound which mound is anchored at the center of the inside circle, surrounded by an outer circle, found to the middle of the rectangle if indoors and found towards the end of rectangle if outdoors players vie to spin. Each spin is for a score or a chance to complete a score through the use of a Bar that is specifically made for lifting various weight, through a quick snapping motion by a player, with their wrist. This game is further characterized by blocks, tossing maneuvers of other players, bumping, holding, jettisoning, (tackling and running maneuvers if outside) by the players, to get their team in a position to make either the horizontal rotate or make a run up field into the safe zone.

3 Claims, 15 Drawing Sheets

Fig 1-A
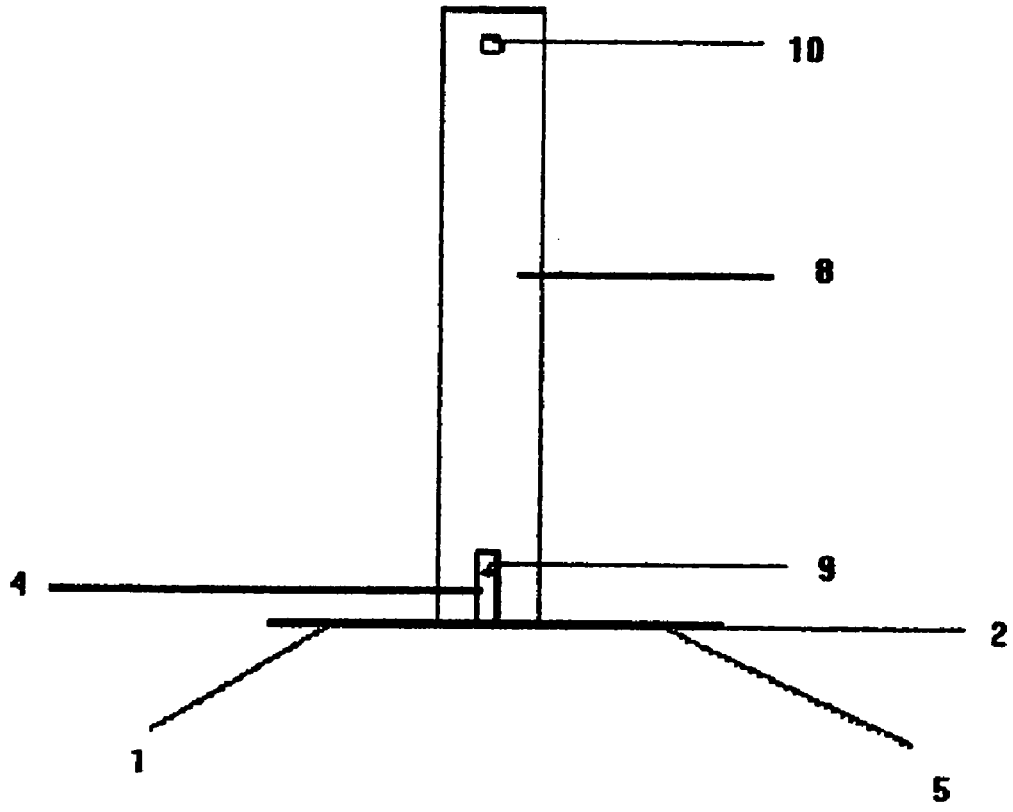

Fig 2-A
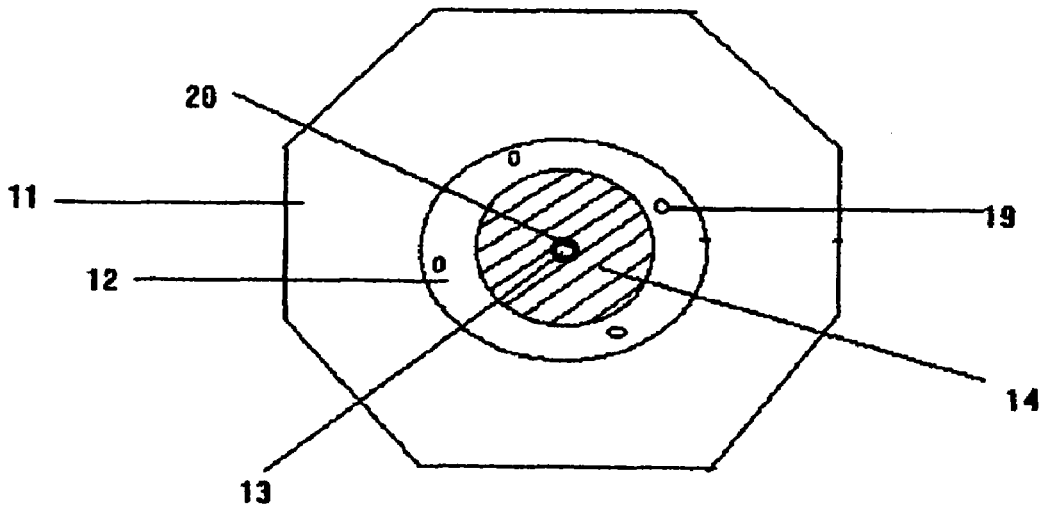
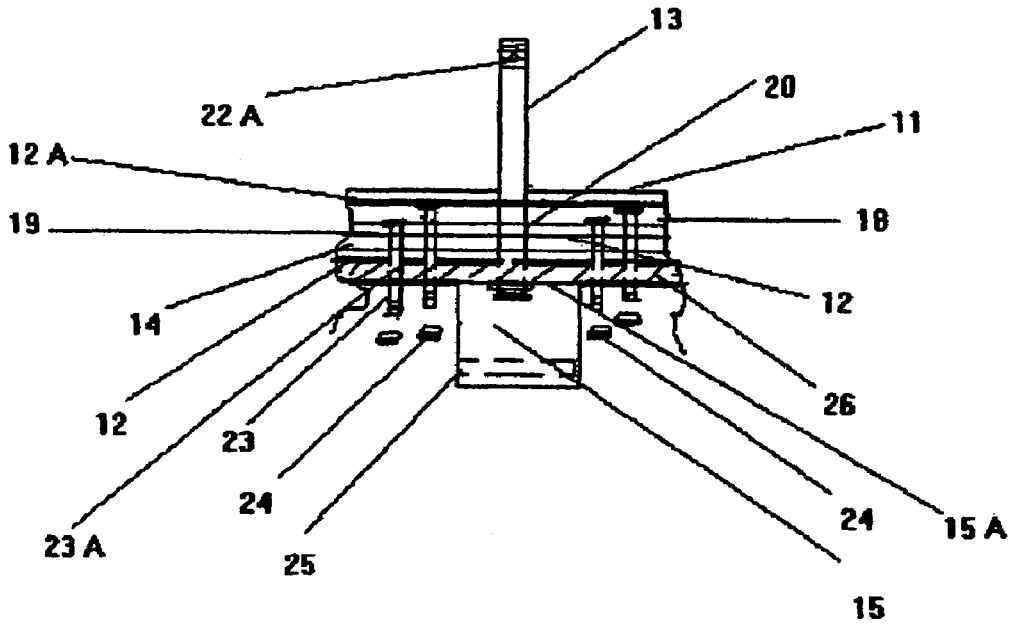

Fig 2 - B
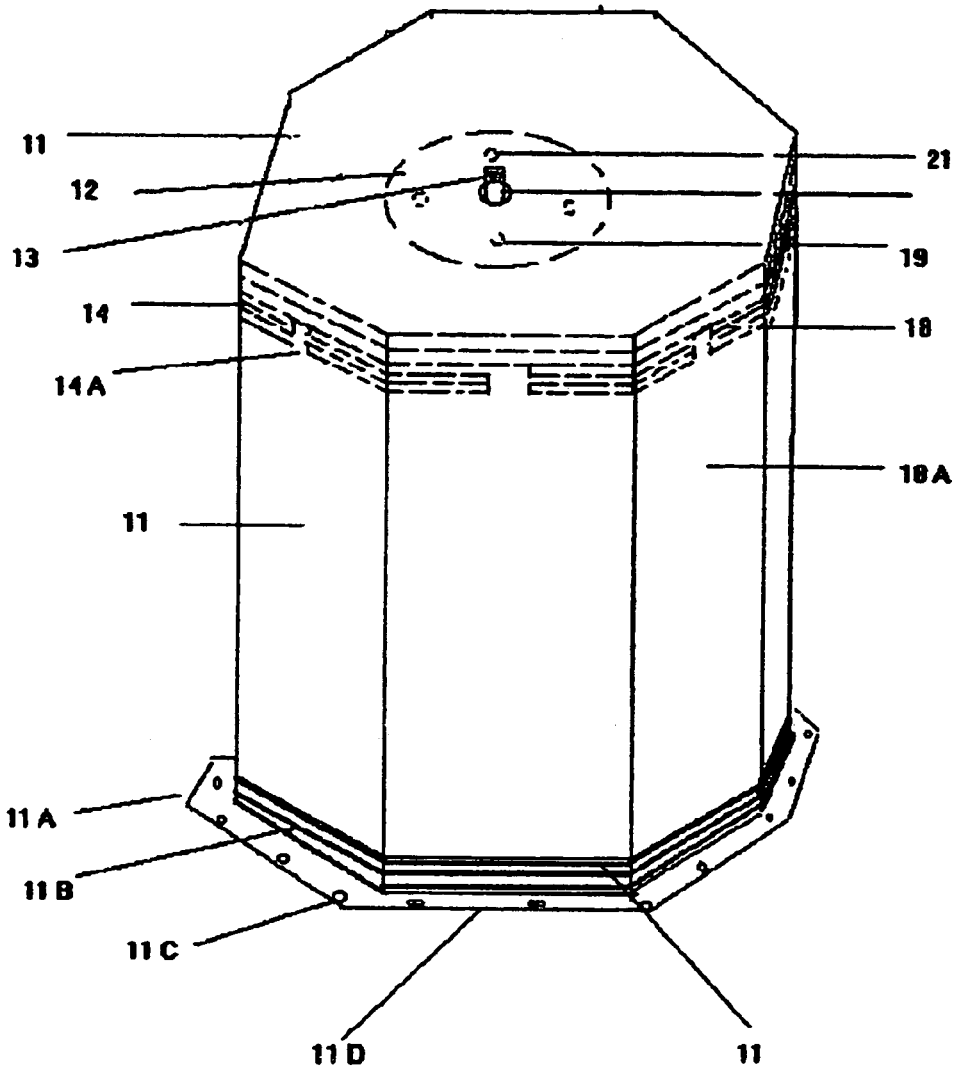

Fig 2 - C
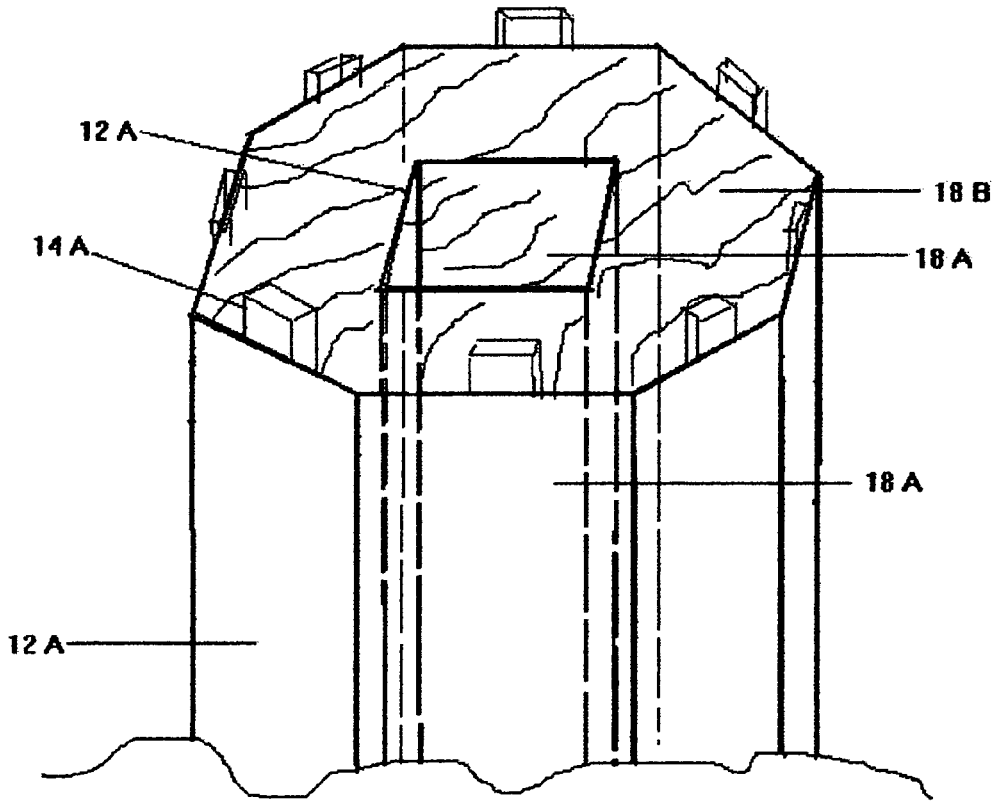

DICTIONARY DAZZLE

CROSS REFERENCE TO RELATED APPLICATIONS

This application is a Continuation-in-Part of patent application Ser. No. 10/093,817 filed on Mar. 11, 2002-Art Unit: 3711.

BACKGROUND OF THE INVENTION

The invention is equipment used to play a sports game. The game is entitled Dictionary Dazzle nicknamed Dazzle. The field of endeavor to which Dazzle pertains are the contact and semi-contact sporting arenas. Sporting events have evolved along with man's evolutionary process and helped to play a vital part in the developing, as well as the maintaining of newly acquired physical and social knowledge. Although sporting events no longer flourish with the use of weapons, athletics still apply themselves daily, to be the best through mastery of the games and by breaking records.

Today the more popular sporting events named baseball, hockey, basketball, football, rugby and soccer are found in the contact and semi-contact field of sports. In each of the areas their focal piece of equipment used for playing the sport is usually called a ball. Dazzle a contact or semi-contact sporting game does not utilize a traditional inflatable, hard core or semi hard core type ball that's found in the aforementioned events. Dazzle's novelty is in the fact that it is a contact sport that is played without a projectile. The sport is played from a stationary piece of equipment which initiates action just as exciting as you'll find in other contact or semi contact sports. Uniquely the equipment's main section which provides a means for the anchoring mechanism, is made from very flimsy materials. Padded linen cloth or even form rubber is adequate. The main section is that portion of the mound which players inadvertently collide with during play. It is anchored to a standpipe called the upright or when the standpipe is omitted, is anchored through simply extending the flimsy material and is fastened through the flap(s) where the material terminates. Because the main section lies in a plane, it makes it more accessible to be reached into by the player, seeking a chance to launch its impel able device. The main section that is made up mostly of flimsy material is more than sturdy enough to withstand players banging up against it as they struggle to move the impel able called a horizontal, attached, atop the mound. And that is the objective of this game, to fight your way in to the horizontal and move it a full revolution.

This sport has never been played before. A projectile like object is normally used to spur players to action, but is no longer required for exciting, stiff competition to take place. When players vie to impel the horizontal (a movable object in a stationary position), their attempts to do so creates an immense amount of contact between the players. This new spirit of competition that is played I have termed an Impelled Stationary Device Action Game or ISDAG. The novelty of this invention is in the equipment just mentioned as well as the planar surface it is played on, that is different than other contact and semi-contact games.

In modern sports, Dazzle is similar to football if played outdoor. But unlike anything you have ever seen before, is its method of scoring. When played outside, points are given upon the completion of a series of steps. A>B>C and after C then you can score. Interesting concept wouldn't you say. As I mentioned earlier a mound is the apparatus action focuses on in a contest of Dazzle. The horizontal atop the mound believe it or not ignites the action, as if it were a ball. And it gets more interesting. In football, its competitive action takes place when an attempt is made to move the football towards an opponent's end zone; in soccer, the competitive action takes place when an attempt is made to move the soccer ball towards an opponent's goal net and in basketball, its competitive action takes place when an attempt is made to shot the basketball through an opponents net. Repeatedly the objective that has defined competitive sports action has been found in projectiles and balls. In football, the translocation of a ball crossing the goal line to produce a score defines the action; in basketball, the translocation of a ball passing through a hoop also defines the action; and the same is true for soccer. Our games have given us balls for fun and excitement. Dazzle is a change from that routine. Like for instance one that does not have its objectives nestled in the translocation of a ball.

Since their incision in the field of non combat competition, competitive games have been generally played outdoors, except for basketball and hockey. Of which hockey uses a puck instead of ball. But the objective to which they have been played has never been changed. It has remained just the science of the translocation of an object, for the expressed object purpose, that has found scoring, being done by a projectile. But the tenet of Dazzle is different. First, in focal equipment translocation and Second, through scoring. In Dazzle the projectile is not a ball given a projected path when launched by the player, but a movable device, when impelled will follow, a predetermined path after launch. And then its motion is always circular. But rest assured, scoring is not as simple as the translocation of an object or moving a ball from Point A to Point B. Even more interesting is the number of formats available for playing ISDAGs. In the original format discussed here in this application, scoring results from A> when players impel the horizontal at least one revolution around the mound B occurs; B> player has won the privilege of attempting to run way up the field and if without being knocked down or held they reach the connecting zone, the player then request the official to add additional weight to a Bar, they will attempt to lift in order to increase their team's score when C occurs; C> after the player reach the connecting zone, the player then must run from the connecting zone pass the follow through into the safe zone. If successful, only then is that player allowed an opportunity to lift the Bar. It must be in one continuous flick of their wrist with their arm extended If they succeed, then their team's score shall increase by the mutable of a number listed below the spot on the mound where the horizontal stopped, for each particle of weight, they successfully lifted. However, once any weight is placed upon the Bar, it stays there unless special conditions, due occur. Interesting? Yes, I would say its very interesting. Dazzle makes for a most exciting contest but yet, Otherwise the traditional teachings which have given grace to athletic competition are very much still fundamental. In short, the mound is a fresh new idea in an old world of contact and semi-contact athletic competition, which has its objective in wrist snaps.

BRIEF SUMMARY OF THE INVENTION

The invention is specially designed equipment call the mound nicknamed a portable form that uses a device on it called the horizontal, which all the rest of the portable form is specially designed to ensure safe movement of that horizontal, in an athletic contest entitled, Dictionary Dazzle. The portable form measures approximately fifty-four and three-quarter inches in height by thirty six-inches at its longest width point and is eight sided. Atop the invention is the horizontal connected via of a bore through on an axis rising through a flat surface. The horizontal rest upon a glide washer and has a cap covering its fastener. This surface gives the portable form its eight dimension sidedness and measures approximately twenty-one and one half inches (21½") by twenty four inches (24") and is approximately eight inches (8") in depth. Within the surface are mounts where below attaches a steel cylinder or shaft to its center. The surface rest upon an upright and conventional padding already available is not a part of the invention, but can be placed around the upright for players protection if the alternate design of extended flimsy material is not used.

The game combines various formats of team play together with wordplay, mathematics and preselected categories of academic questions (which are optional and not discussed in this application, but can be found in a separate accompanying Appendix sent with this application), to create a very unique experience for players whether it be during the contact competitive form of play or the semi contact form of play. The object of the game is for the players to attempt to propelling the pointer called a horizontal, one full revolution to result in a score, while being bumped, held or knocked down by defenders in one format or for the players to attempt to propelling the horizontal one full revolution for an opportunity to run up the field into the safe zone, for a chance to attempt a lift of the Dazzle Bar for a score, in another format. The game requires endurance, speed and a high level of coordination for a player to maneuver their way into the horizontal. Once there as defenders attempt to hold the horizontal, bump and hold that contestant and attempt to knock them down, as the contestant attempts to propel the horizontal, a great deal of accomplishment can be derived by any player crafty enough, to succeed in this act, if their turn is counted as being good, by the officials.

Dazzle is played on a unique rectangular playing surface measuring 62 feet by 42 feet for indoor competition, with and inner and outer circle about mid court; or on a 110 yards by 45 yards rectangular playing surface when played outdoors, with the inner and outer circle toward the end of the field, away from the Connecting Zone, the Follow through and the Safe Zone containing the Lifting Pad. Because the game has contact as a main component, players use arm pads and knee pads for protection The game is played in two halves with five players on a squad. Prior to starting a half players, line up staggered around the outer circle, to await the official's spin of the horizontal. This is the signal to start play. The team which will start on offense is decided before the game through a coin or die toss. Other features, characteristics and novelty of the invention will become apparent as you read through the following Detailed Description of the Drawings.

BRIEF DESCRIPTION OF THE SEVERAL VIEWS OF THE DRAWINGS

FIG. 1-A is a perspective drawing of the anchoring mechanism supporting the upright.

FIG. 2-A is a perspective drawing of a cutout section showing how plies are arranged to form a main section and the attaching flange.

FIG. 2-B is a perspective drawing of an alternative design to support the main section and anchor the mound. The upright and anchoring mechanism seen in FIG. 1-A are no longer used in this alternative design.

FIG. 2-C is a perspective partial drawing of the alternative design shown in FIG. 2-B, but it is composed of two different sections to make the anchoring and support system sturdier.

DETAILED DESCRIPTION OF THE INVENTION

Figure 4:
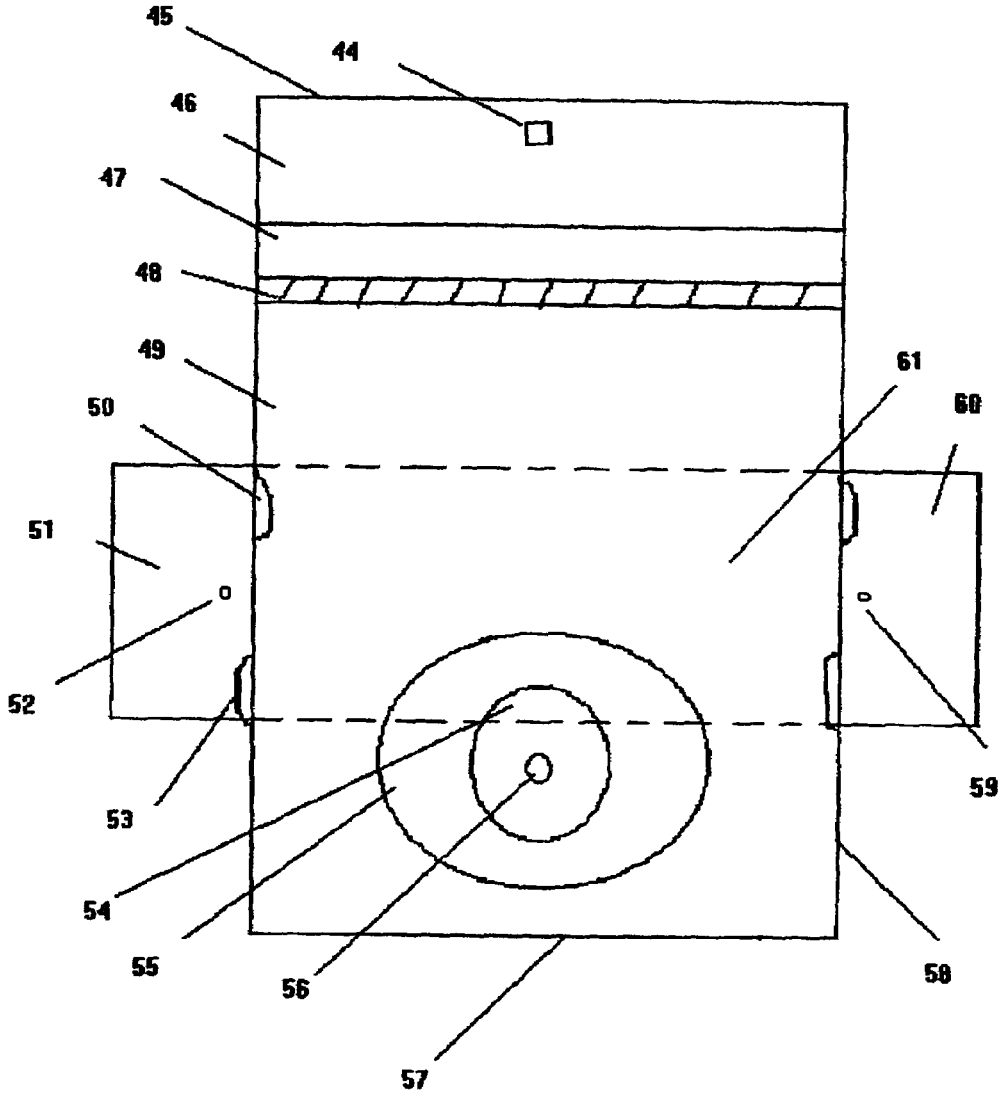
FIG. 4 is a perspective drawing of the outdoor Dazzle field.
Figure 6:
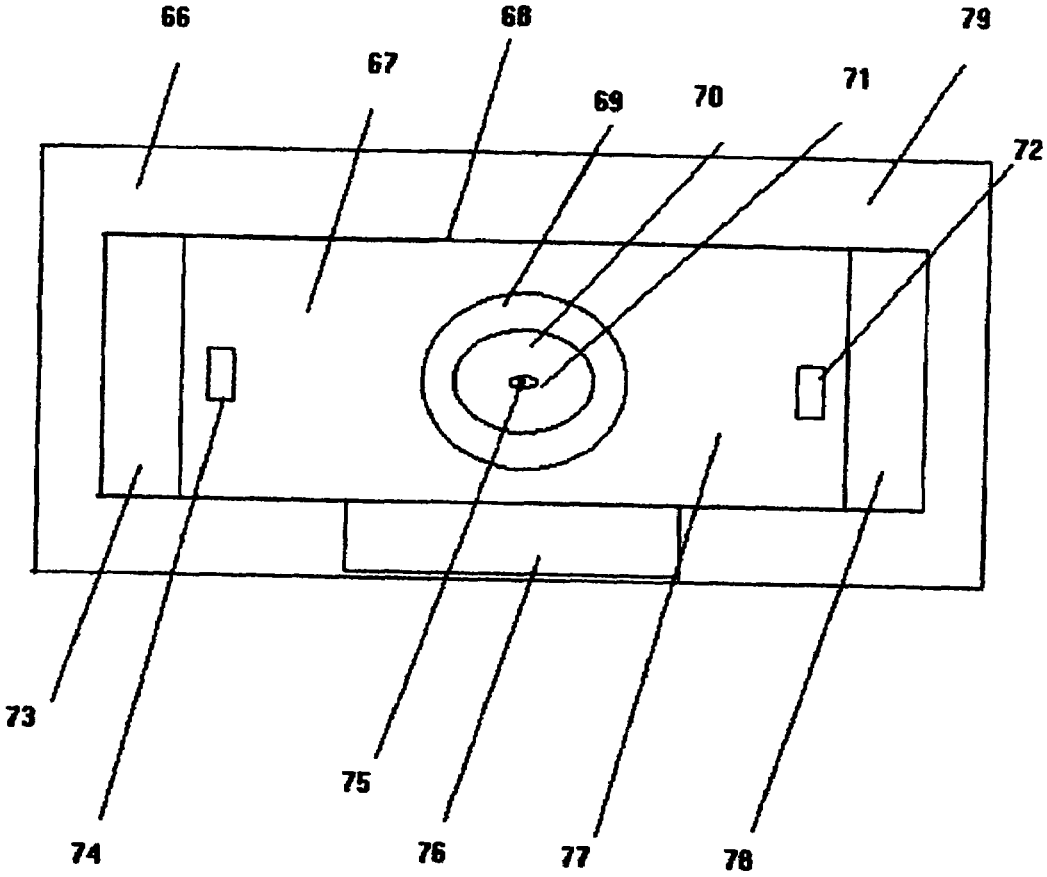
FIG. 6 is a perspective drawing of the indoor Dazzle court.
Figure 8:
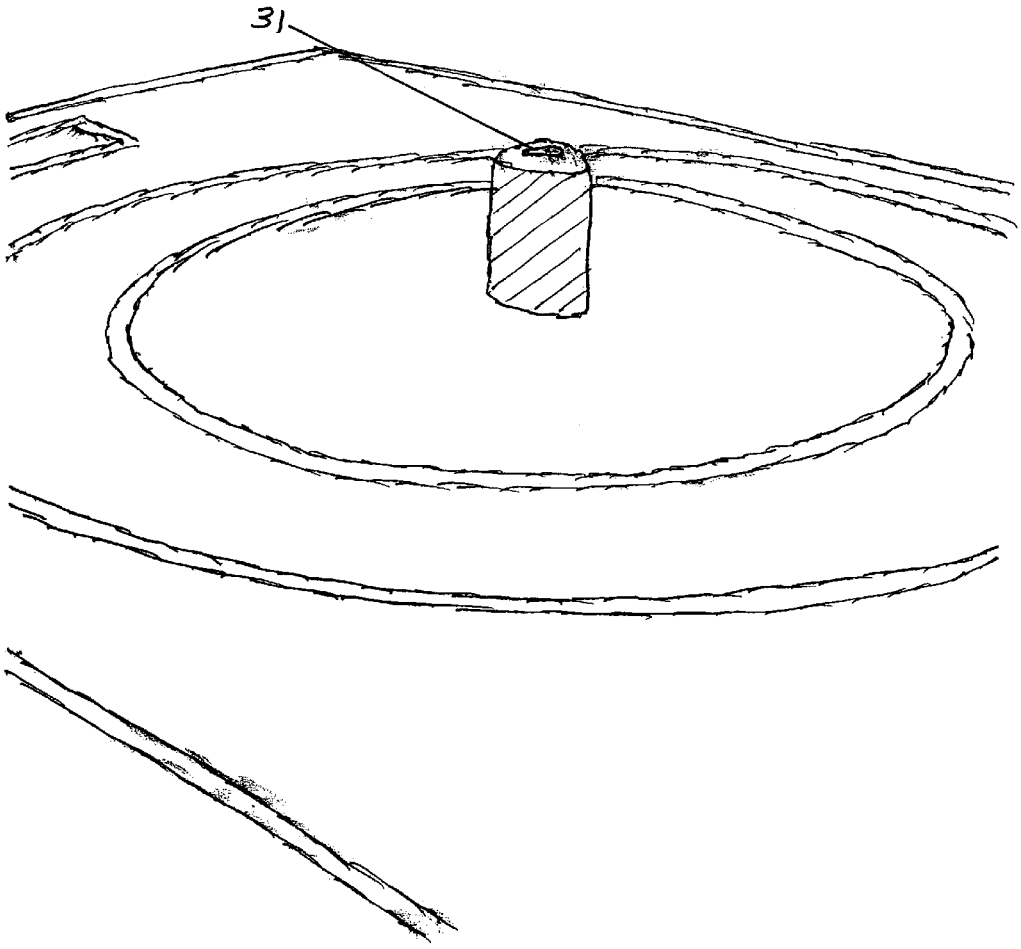
FIG. 8 is a Drawing of a portable inside court (setup outdoors).

FIG. 4 illustrates the outside Dazzle playing area and FIG. 6 illustrates the indoor playing court along with FIG. 8 is a Drawing of a portable indoor court set up outdoors. On an outdoor field its design includes a main playing area 49, which extends for both the majority of the length and width of the field. Other components of the field who's use will become evident later in this application are the qualifying area 61, the penalty areas 51 & 60 with microphones 52 and 59, a connecting zone 48, a follow through 47, a safe zone 46 containing a lifting pad 44, the outer circle 55, the inner circle 54, the dazzle mound 56 and the boundary lines 45, 57 and 58 surrounding the field and its penalty areas. On an indoor court it's design includes the main playing area 67 which extends for both the majority of the length and width of the court. It's other components are penalty areas 73, 75 and 78, lifting pads 72 and 74, an outer circle 69, a inner circle 70, the dazzle mound 71 and microphone 75 suspended over the mound, and boarder line 68 which surrounds the court and its penalty areas and if a portable court, Canvex surface 79, which is of one piece construction 85 feet by 54 feet in diameter, of which the lines of a court are drawn.

Indoor and outdoor facility designs vary from one another because, there is no running portion of the game associated with scoring when played indoors. Therefore the court is smaller and the mound is centralized. While a field measures 45 yards by 110 yards and playing courts measure 62 feet by 42 feet, action is split between a mound and safe zone on a field's surface and most action takes place around the mound on the court. Although exact dimensions of the penalty areas are not critical, their size must be adequate enough to comfortably separate players incurring an infraction safely away from the action of the game. Both games however use the same mound despite variations within the measurements of the outer and inner circles housing the apparatus. Circles on a field measure 88 feet in diameter for the outer circle and 38 feet in diameter for the inner circle and circles on a court measure 35 feet in diameter for the outer circle and 24 feet in diameter for an inner circle. How the game is played i will now described.

Teams consist of five players each. While as many as five teams may play against one another in a single contest outdoors, that number reduces down to a maximum number of three teams indoors. Each of the players wear protective gear in the form of arm and knee pads while only that player designated as the spinner utilizes a helmet. The games begin with the players lining up around the outer circle (FIG. 4, item 55 if outdoors or FIG. 6, item 69 if indoors) after a coin or die toss has determined the offensive order of the team. Teams use staggered lines where no team's players may line up next to their own teammate(s). Teams remain in this formation until an official spins the horizontal atop the mound, FIG. 4, represented by item 56 and FIG. 6, represented by item 71 (FIG. 3 item 31 and shown in FIG. 8 item 31) atop mound 56 and the game is on its way. Offensive players take their turn in a order arranged by the coach, and the order remains unchanged through the game, even during a substitution. The object of the game is for the offensive player designated as the spinner upon their turn, to make their way into the inner circle FIG. 4, item 54 outdoors or FIG. 6, item 70 indoors and spin the horizontal one full revolution. A period of forty seconds or other predetermined time period is allowed to do so and if the designated spinner fails to make an attempt, one of the team's chances is lost. Each team receives two or a predetermined number of chances during the offensive turn to complete a spin and only the designated spinner and defense, have unrestricted access, into the inner circle. Offensive teammates can enter the inner circle for only brief periods to aid the spinner. The exact time cam be decided otherwise it is 3 seconds for indoors and 5 seconds outdoors, that an offensive teammate can remain in the inner circle. The penalty for staying too long results in a lost of one chance. Aid is generally given through bumping, tossing, holding and blocking the defensive opponents out of the designated spinners path. And the defense can do likewise in their efforts of stopping the spinner from completing a spin.

Figure 5:
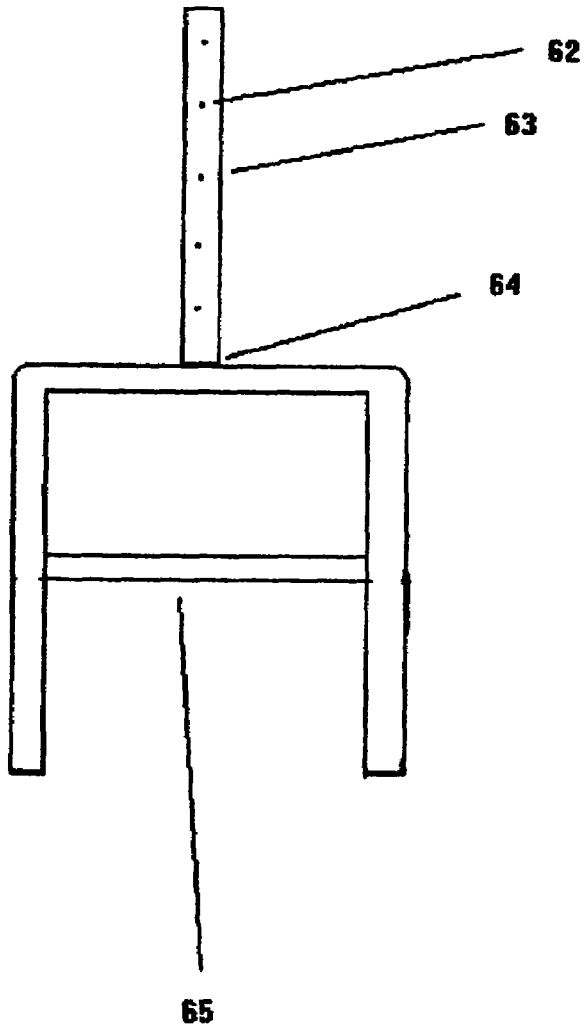
FIG. 5 is a perspective drawing of the Dazzle Bar, a weight lifting device needed in scoring.

During indoor contest, completed spins counts as one point and then the spinner is given an opportunity to score extra points by lifting weight they can have added to the dazzle bar, FIG. 5, but only if in accordance, with the instructions printed atop the mound. See instructions shown in FIG. 11. If the spinner successfully lifts the weight that is added onto the bar, their side's score will increase by the multiple of the instructions, times the weight, added to the bar. Either way fail or succeed during after a point scoring attempts, this ends an offensive turn unless otherwise decided.

During outdoor contest, a completed spin will give the spinner five chances to run up the field and into the safe zone for a chance to score, if in accordance, with the instructions printed on the mound or the spinner can hand the run off to a teammate. After the completed spin, the offense lines up inside outer circle 55 FIG. 4, facing the safe zone and the defense lines up facing them on the outside of outer circle 55. The designated spinner is now the designated runner and with the aid of their teammates attempts to run up the field. The defense through bumping, tossing, holding, blocking and tackling tries to make the runner's hand(s) touch the ground. Each time this happens, the runner loses one of its chances to reach the connecting zone and run on into the safe zone afterwards, for the attempt to score. If the runner reaches the connecting zone, FIG. 4, item 48, the runner is given an opportunity to have an official add weight to the bar, if in accordance with the instructions. The official takes whatever time necessary and adds the weight to the bar. Now if the runner make it pass the follow through and reach the safe zone before their chances have expired, the runner is given 15 seconds, to enter the lifting pad and hoist the bar. If the hoist is successful, the runner's team score will increase by the multiple expressed, in the instructions.

Games are played in two 42 minute halves for adults and time is reduced for younger classifications of adults and children. Each team is given three time outs during each half. If a game ends in a tie, the tied teams will play five minute increments of sudden death until the tie is broken. When players commit serious infractions during a game, that player is sent to the penalties area for a play segment or removed from the game. Other infractions allow free spins and free lifts, a reduction in the numbers of chances left to score and being barred from the inner circle during segments, which are the amount of time a team has during their chances to score. Optional aspects of this game are the academics and qualifying portions. Qualifying involve selection and performance of athletic feats players perform prior to games that qualifies them to play in the upcoming contest. Academics involve knowledge players must display before the microphones during the game when the pointer lands on a certain category, in order for that player to remain in the contest. Challenges also can be made if a team thinks the information given is incorrect. More of the various rules, penalties and official signals governing the contest accompany this application in a separate appendix. This information is separate of the application and presented only as a reference source for the examiner, by which they may further understand the outdoor game, in the event questions arise regarding its bounds. Now I will describe the mound shown in FIG. 1 and FIGS. 8 and 11 along with portions thereof in FIGS. 7, 9 and 11.

Figure 7:
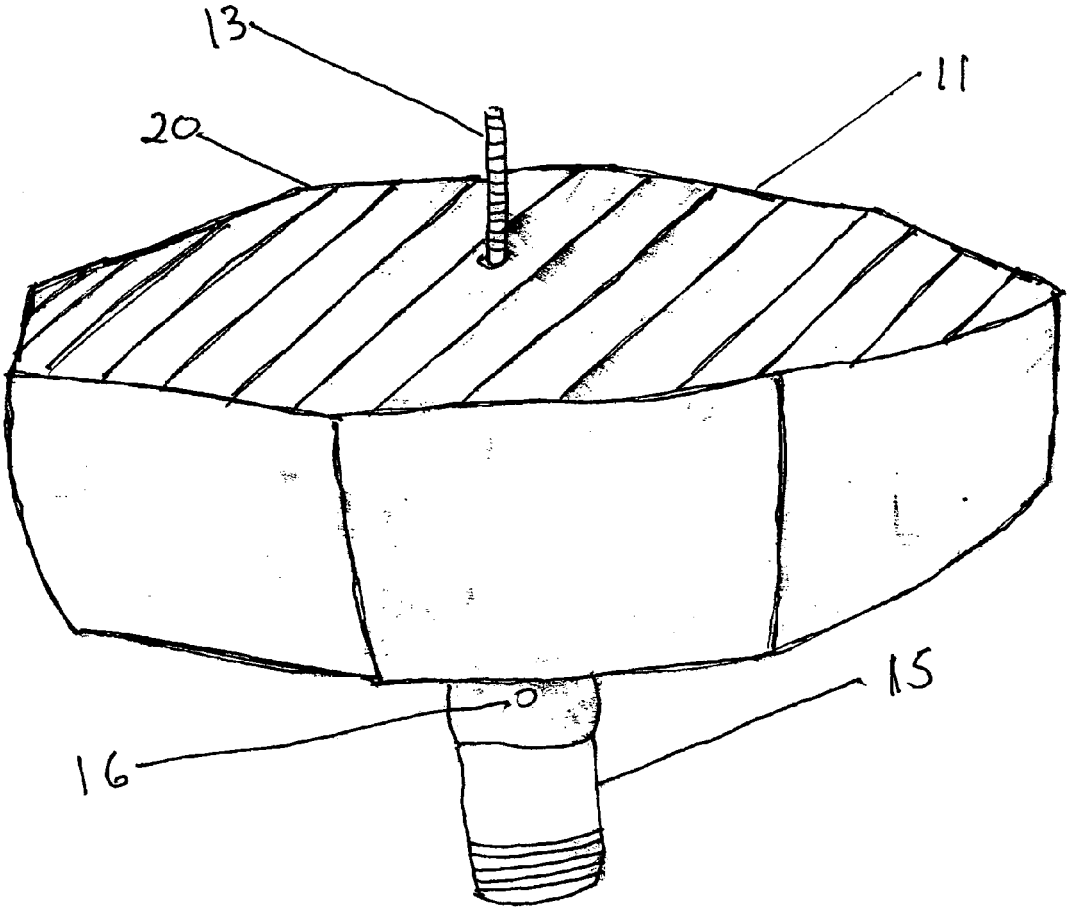
FIG. 7 is a Drawing of the main section of a mound showing the protruding shaft atop and its attaching flange below.
Figure 9:
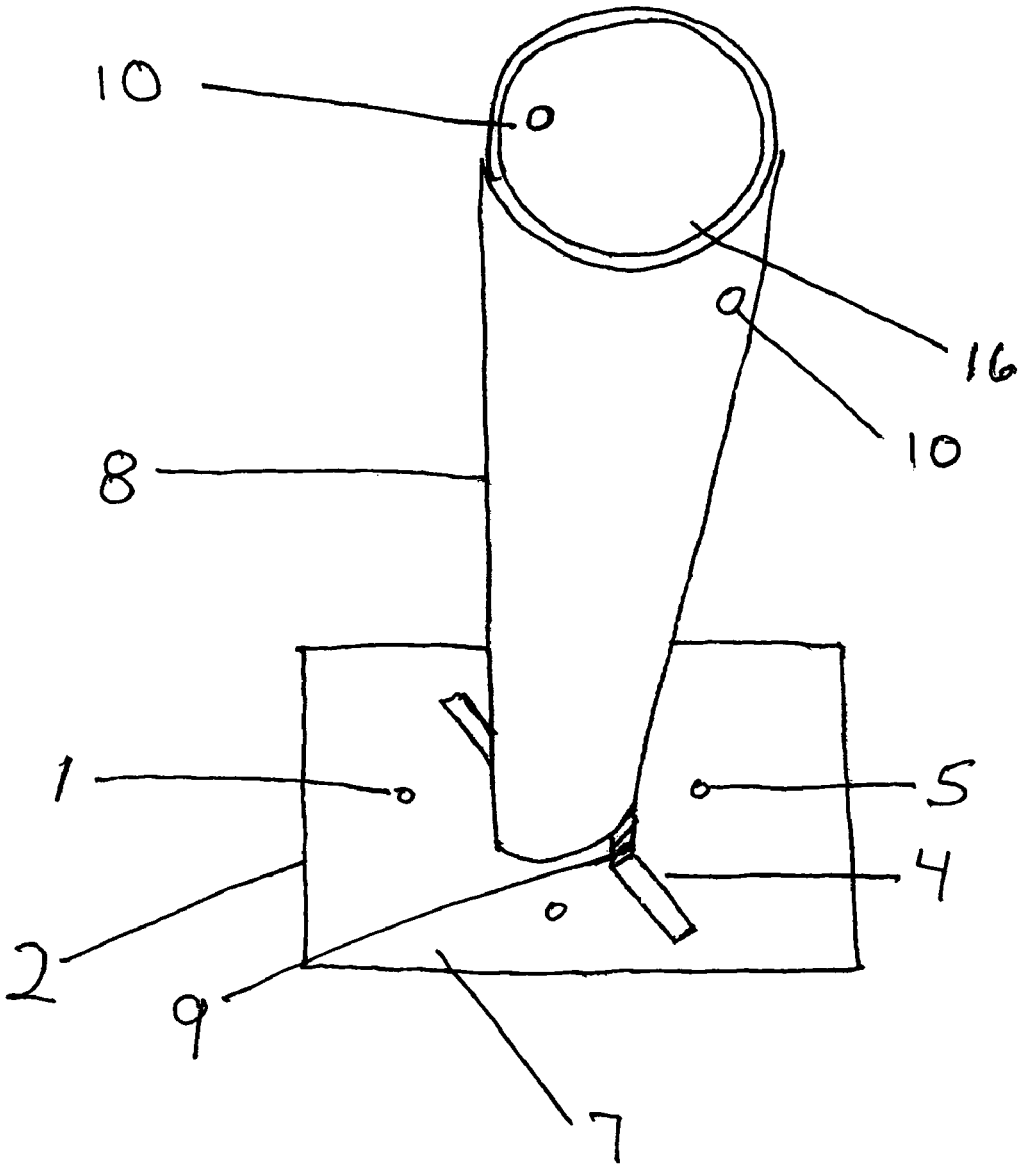
FIG. 9 is a Drawing of an upright along with the anchoring mechanism.
Figure 10:
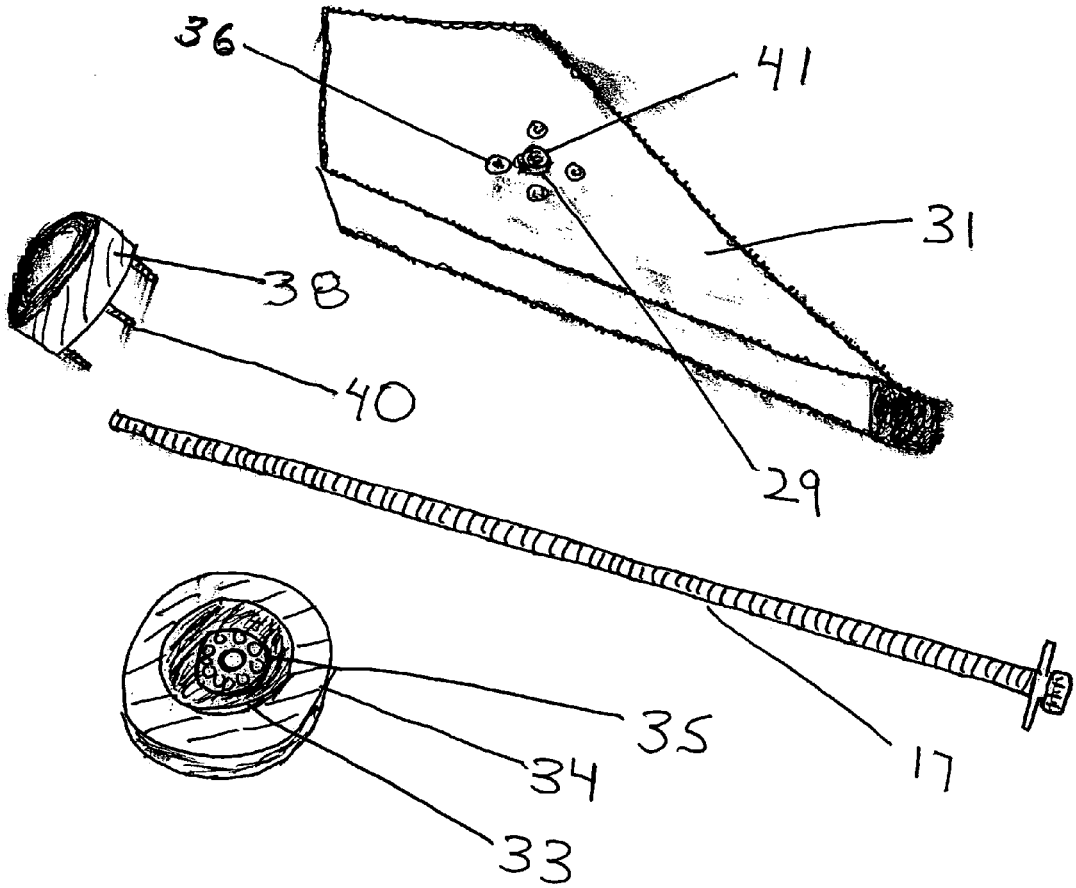
FIG. 10 is a Drawing of the horizontal, the glide washer, an absorbent cap covering the retaining nut and the anchoring screw.
Figure 11:
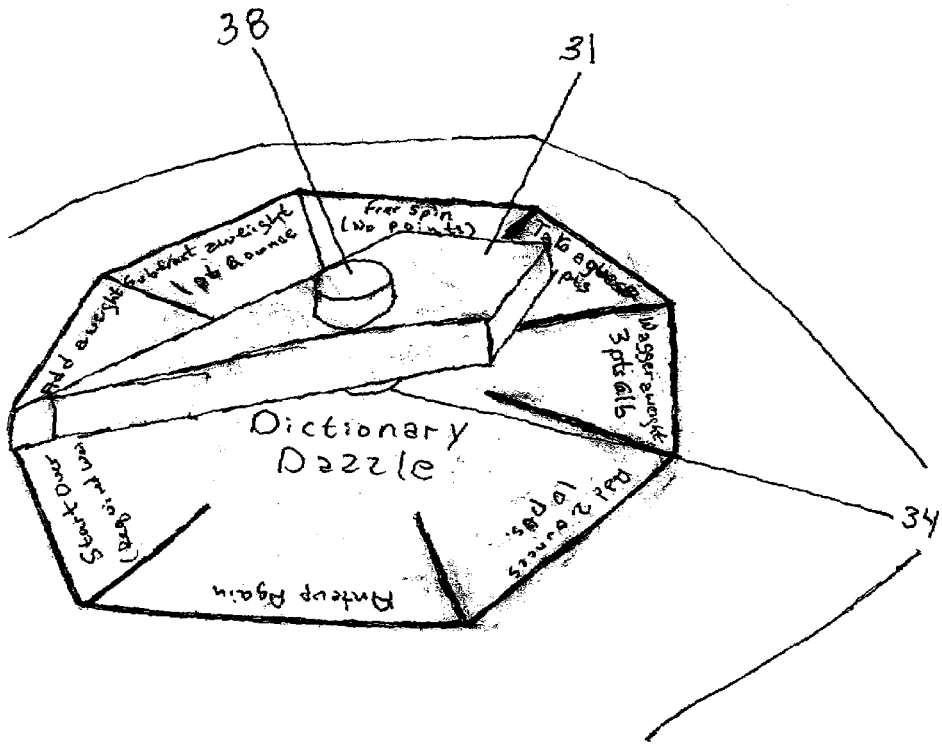
FIG. 11 is a Drawing of the top of the mound showing instructions below the horizontal used in conjunction with the Dazzle bar and scoring.

The mound or component assembly shown in FIGS. 1–3 and FIGS. 8 and 11 along with portions thereof in FIGS. 7, 9 and 11, constitutes the catalysts as if it were a projectile and creates a tremendous amount of competition, among persons, who engage in the act of attempting to impel the horizontal, that's attached, to the top of the mound. The mound can be made from various materials such as metal, vinyl, cloth, form rubber and cloth inserted rubber or in conjunction with these materials, along with trapped air. The simpler means of construction which omits the trapped air and uses layers of cloths or form, vinyl and/or cloth inserted rubber, instead is described below. With the use of FIGS. 1, 1-A, 2, 2-A, 2-B, 2-C and 3, how these materials come together and form a mound will become obvious to a person having ordinary skill in the art to which the said subject matter pertains. The description of the invention will now be given.

Figure 1:
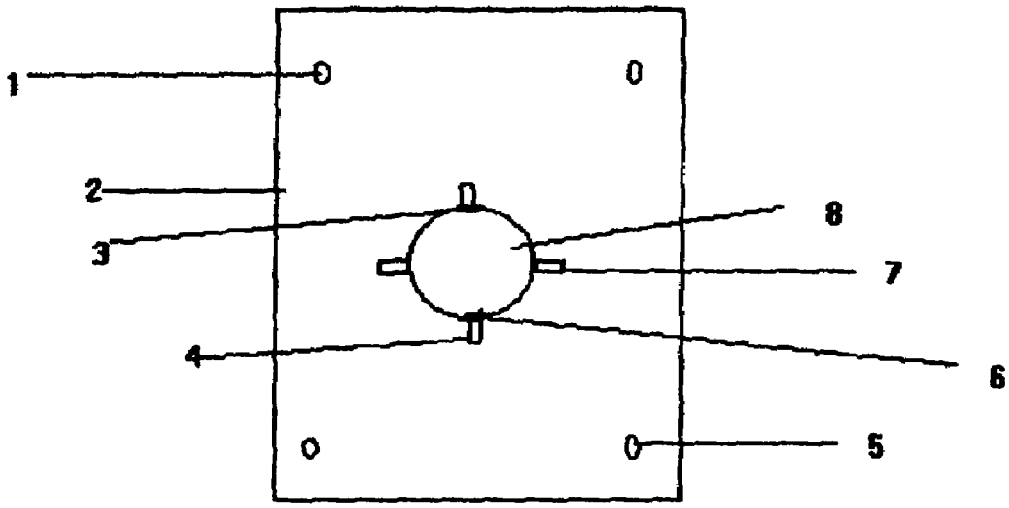
FIG. 1 is a perspective drawing of the anchoring mechanism.

1) FIG. 1 is a plan view of the anchoring mechanism 2. It is a metal plate and pole 8, called an upright. (See FIG. 9) Holes 1 to the topside and holes 5 to the topside and the holes 5 to the bottom of the plate, allow bolting to the earth or other structures. This bolting is what gives the upright and components that attach thereto, their stability. L braces 4 are weld to the plate or made in the bottom of plate 2. There are there to securely fasten the upright to the plate, through brace 4, which can be seen better in FIG. 1-A and FIG. 9 are bores 3. They aline with holes 6 within the upright. Anchoring bolt 9, also better seen in FIG. 1-A and FIG. 9 secures plate 2 to upright 8. Leveling strip 7, also made in the bottom of plate 2, for evening the surface upright 8 rest upon, is also present. It is just a flat piece of a bar welded or made into the plate and it completes FIG. 1.

2) FIG. 1-A shows an elevated view of the upright and anchoring mechanism. From this view the bolt labeled 9 through brace 4 that secures upright 8 to plate 2 are evident. To the top of the upright, there are two bores 10 that creates a passageway 16. Bores 10 are there to aline with passageway 25 in shaft 15, seen in FIG. 2. The shaft, is attached within the main section, and when the shaft, is placed inside upright 8, passageway 25 of the shaft, and passageway 16 of the upright, aline with one another. That allows an anchoring screw to fasten the main section to the upright.

Figure 2:
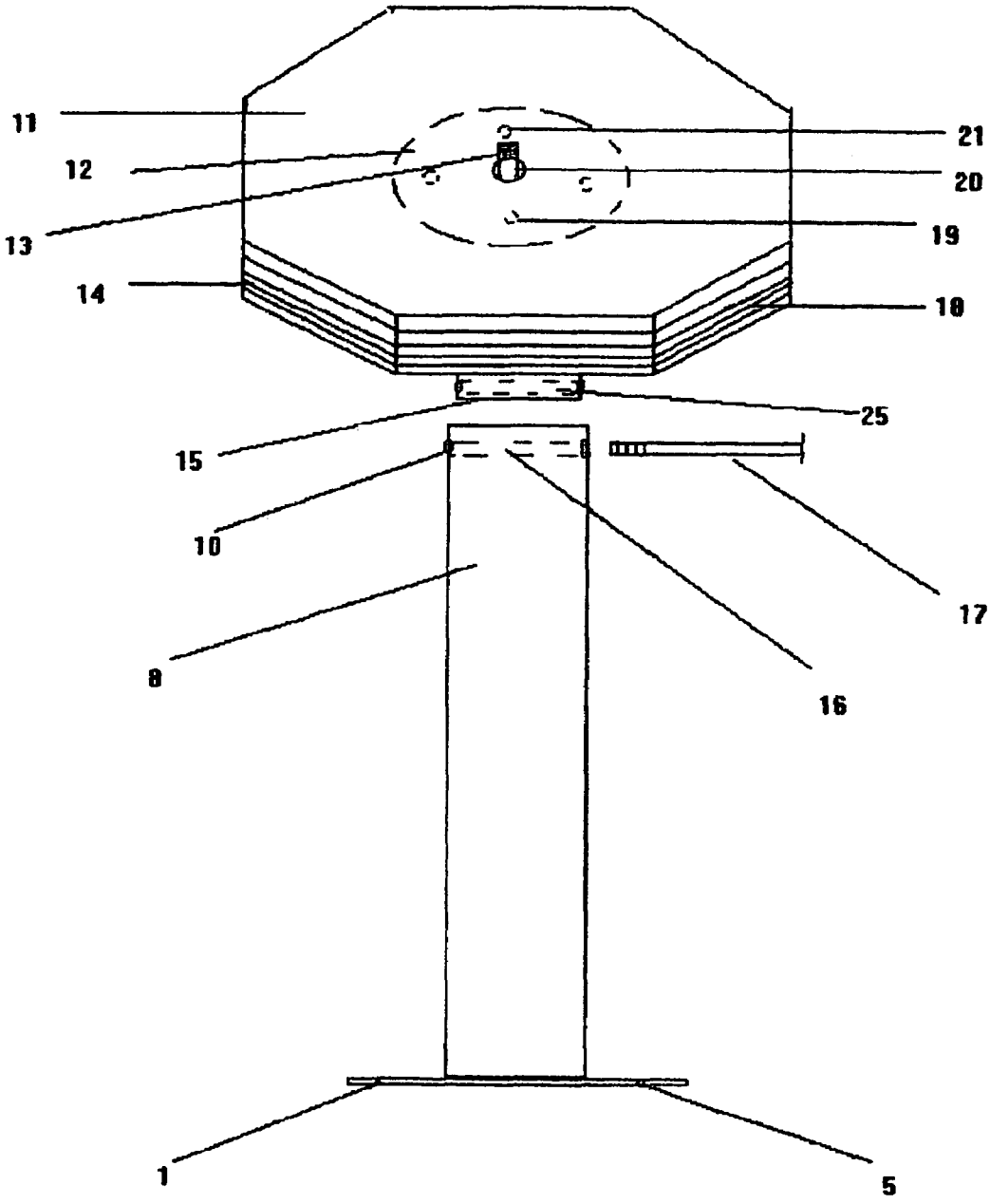
FIG. 2 is a perspective drawing of the main section of a mound, the anchoring screw and the upright along with its anchoring mechanism.

3) FIG. 2 is an elevated view of the main section that shows how a anchor screw 17, secures shaft 15 to the upright. Also in this view, five thick layers or plies of absorbent material 14, all identical, laid upon one another, can be seen. Between each plier, laid on its top and bottom, laid in the center, there is a cloth inserted disc 12. This disc measures, a little over two-third of each ply's, total area. In each disc, there are four holes 19. These holes, aline with each other, when all the plies are placed one on top the other. Disc 12, are glued to the center, of each ply, on both top and bottom. Then the first four plies are glued together. If cloth is used, glue is stopped about an inch and one-half before the edges. Now through holes 19, of the first four plies 18, bolts 23, better seen in FIG. 2-A, go through bores 23 A, made into metal disc 26, of which shaft 15 extends. These holes or bores 23 A, aline with the holes 19, containing bolts 23. Next lock nuts 24 are placed onto the bolts and this process securely fastens disc 26, to pliers 18. Through the center of each plier, cloth and metal disc also lie a bore 20. A bolt 13, approximately one-half inch in diameter is placed through these holes. But before this happens, the fifth and last ply, which is a solid disc 12 A, without any holes 19 or bore 20, twice the thickness, of all the other disc 12, is glued to the bottom, of this final ply. Then, the last ply is glued over the forth or top plies. Now bolt 13, is placed through, bore 20. It can be seen, protruding up through, the main section, and terminating above The horizontal anchors to bolt 13. Now surface (11) made of ⅛", cloth inserted rubber, is going to be placed over the pliers, protruding bolt and metal plate. The shaft will be allowed to protrude, through the surfacing. Bolt 13 can be removed, to make a bore in surface 11, for the protrusion, of bolt 13 and put back after, surfacing has been completed. In FIG. 7 shaft 15 with anchoring bore 10 and protruding bolt 13, terminating above a main section are identified.

4) FIG. 2-A is a plan view of the main section without the horizontal along with a cut out perspective drawing, of that portion of the plies 18, that house mental disc 26, with its attached shaft 15, held to disc 26 through weld 15 A. Disc 12 A, that is glued to the bottom of the fifth and last ply, is a barrier disc, there to prevent bolts 23, from working their way up through, the last ply. Bore 20, the passageway through the center of metal disc 26, pliers 18 and disc 12, for bolt 13, a fastening means for the horizontal, seen in the arrangement, shown in FIG. 2-A, help make it fairly obvious, to those skilled in the art, to which the invention pertains, how bolts 23, can fasten metal disc 26, to pliers 18, through holes 19, of disc 12.

5) FIG. 2-B is a perspective drawing showing an alternative method of composing a mound's anchoring mechanism, the portion below the main section. This method omits shaft 15 and upright 8 along with, anchoring plate 2. Anchoring now is done through an attachment, made of form rubber, glued to the bottom, of pliers 18. This attachment means, for anchoring a mound, added below the main section, is glued onto, and into plies 18, through the extrusions 14 A, that into is fastened, through the flap(s) 11 A. This alternate means, for anchoring a mound, added below the main section, is glued onto, and into plies 18, through the extrusions 14 A, that fit into intrusions, made in the pliers 18, called interlocks. Surfacing 11, now extends, around the entire mound. At the bottom, of the surfacing, four inches (4") up, all the way around the structure, is a strip, 11 A, and it terminates, in flap(s) 11 D. Strip 11 A, attaches to the mound, through stitches 11 B, and glue, that is placed, on both the surfacing 11, and the strip. Made through flap 11-A, are reinforced holes 11 C, which allow the mound, to be fastened, below a playing surface, of a field and covered over with earth or false panels, if a playing court. Additional height is also added to the mound, to compensate the portion extended below the surface, for anchoring, accomplished through holes 11 C, in flap(s) 11 A, below playing surfaces.

6) FIG. 2-C, is a partial perspective drawing, showing a stronger, design variation, of the portion below the main section, shown in FIG. 2-B. This design shows, two separate sections 18 A and 18*b*, made of form rubber. Section 18 A, is the original portion of extension, shown in FIG. 2-B. This design shows, two seperate sections 18 A and 18*b*, made of form rubber. Section 18 A, is the original portion of extension, shown in FIG. 2-B, that ties into pliers 18, and extends below the main section. What remains now, is a fourteen (14") square of the form rubber, with surfacing 12 A The surfacing 12 A, is made of ¼" cloth inserted rubber, or other form of sturdy, yet flexible material. It extends all around section 18 A. The other section 8 B, now added, completes the lower portion below the main section. 18 B also has surfacing, of ¼" cloth inserted rubber or other form of sturdy, yet flexible material. Sections 18 B, fits over section 18 A, and the two sections are glued together. Then both sections, 18 A and B, are glued into and onto the pliers 18 via the extrusions, atop 18 B, that lines up with, the intrusions contained, within the pliers 18, called the interlocks 14 A. Then surfacing 11, made of ⅛" cloth inserted rubber, is placed over the entire structure This design is used if greater durability and strength are needed in the design of a mound when upright 8 and anchoring mechanism plate 2 are omitted.

Figure 3:
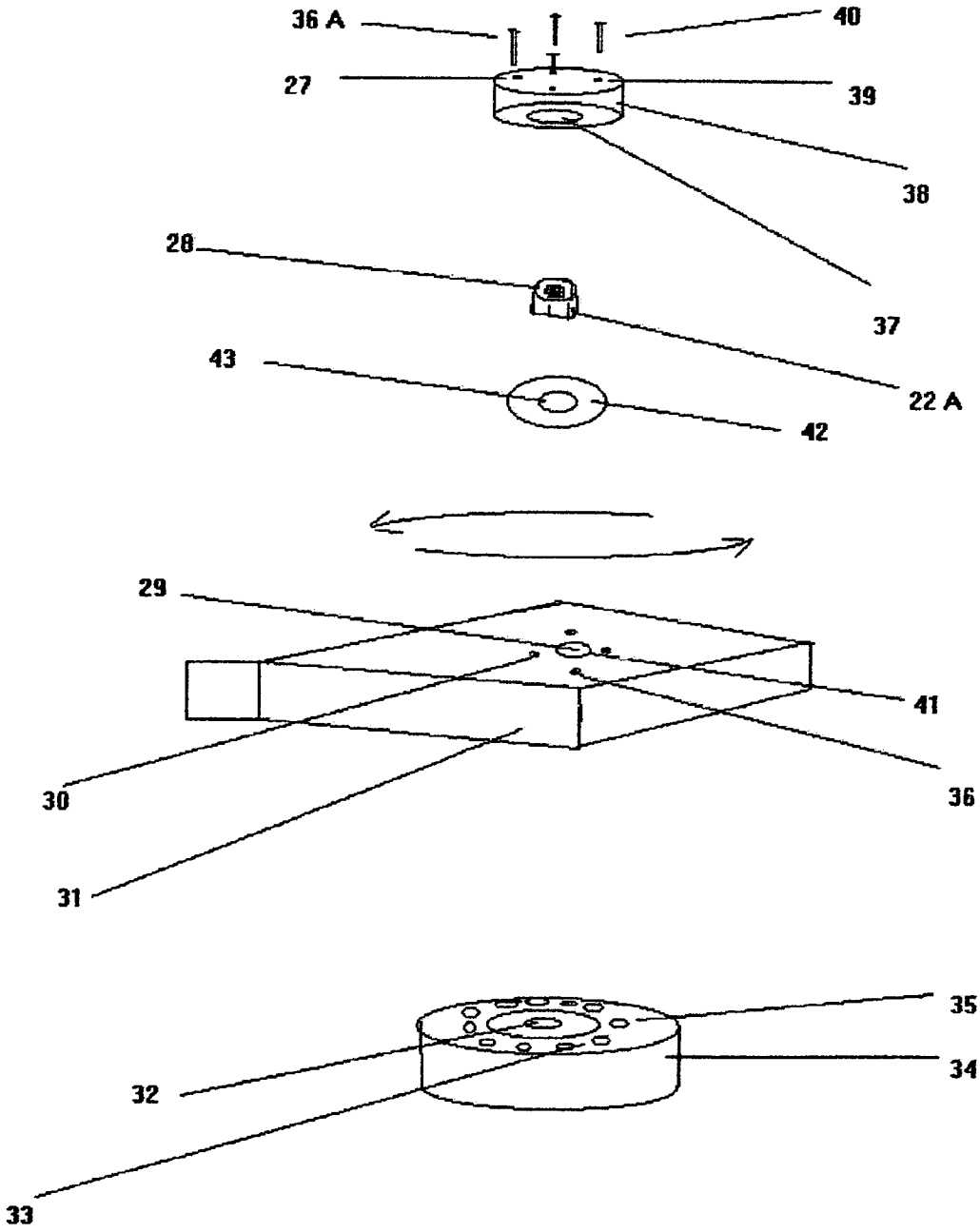
FIG. 3 is perspective drawing of the glide washer a horizontal rides on, the horizontal, the retaining nut which anchors the horizontal to that shaft extends through the mound, the absorbent cap over the retaining nut and the screws which holds the cap in place.

7) FIG. 3 shows the last parts, and their arrangement, that completes, a mound. To the bottom is glide washer 34, containing grove 33. Within grove 33, are ball bearings 35. The ball bearings, which are greased, make it easier for the horizontal 31, to ride over, glide washer 34, on through, its predetermined path, when impelled. Made into the glide washer 34, is bore 32, which allows bolt 13, to traverse glide washer 34 and horizontal 31, through bore 29. Within bore 29, of the horizontal, is tube 41. It protects the horizontal 31, against wear. Also made into horizontal 31, are bores, these bores contain threaded inserts 36. A metal washer 42, and lock nut 28, hold the horizontal in place. A carter pin, is inserted into, slot 22 A, made into the lock nut. Slot 22 A, will aline with slot 22, in bolt 13. Finally a rubber cover cap 38, is fitter over nut 28, via recess 37. Cap 38, is then firmly secured to the horizontal 31, through threaded inserts 36 and screws 36 A. Quick setting gel or rubber plugs, are placed over screws 36 A, which are counter sunk, into the top, of cover cap 38.

Cushion shown in FIGS. 8 and 11 are not claimed as part of the invention and therefore have not been presented.

Conventional padding means already exist and can be adapted to protect, upright 8, holding the component assembly or mound. An example of such padding is presented by Doyle in U.S. Pat. No. 3,104,875. However, due to alternate designs disclosed within the application, Doyle has become unimportant or moot. This is due to processes not being patent able, along with common structures and materials, which have become state of the art, other inventors, other than the originators of those structures and materials, are allowed to have the luxury, of being able to freely use those state of the art, ideas. Nor is a cover presented, or in fact even a necessary item, to the invention and game, for any instructions that are required, can be printed, upon surfacing 11, of the main section, or printed on a separate surfacing, and then glued onto the top, of the invention.

The Dazzle Bar seen in FIG. 5 can be constructed from various materials ranging from reinforced plastic to stone with the use of a mole. In some constructions the eyelets holes seen in the FIG. 5 Labeled # 62 may have to be placed within the extending rod after the bar has been made. These holes allow weights to be secured by a pin or clip.

OTHER EMBODIMENTS AND VARIATIONS

A portable form can be suspended down from a ceiling or other suitable structures for forming other athletic contest. A alternate method for constructing a mound is one which the shaft, an upright and anchoring plate are deleted. See FIGS. 2B and 2C. This method is one that utilizes a single piece of form or two sections of form or other type of rubber(s) and are further lined with cloth inserted ruber or other sturdy material which acts as a securing structure. The two section system provides a much greater anchoring system for the mound. The game of Dazzle can also be played in other arenas other than on an outdoor field or an indoor court. There is no limit to the surfaces on which the game can be played. Contest can be held in the water or on the ice. In addition to other locations suited for playing the sport, feet may also be used as the instrument of impelling horizontal 31 instead of one's hand, when playing the contest.

Dazzle being a totally new idea in sports, no patents were available for comparison. The best mode of making and carrying out, the making and the using of my invention are:

1) by jobbing out the making of parts necessary to build mounds and then assembling those pieces at a central location and
2) the best way to initiate the using of this invention can be accomplished through hosting exhibitions to show how the game is played on public parks and academic campuses.

The invention claimed is:

1. A method of playing a sport game comprising the steps of:

A) Providing a playing field having the following dimensions and indicia;
   1) having a playing area of either 54 feet by 85 feet or 45 yards by 110 yards
   2) said playing area having a indicia comprising an inner and outer circles centered one within another having a diameter measuring 35 feet and 24 feet respectively or 88 feet and 38 feet respectively B) Selecting a plurality of five man teams;

C) Determining the playing order of offense and defense teams;

D) Having the teams line up staggered around the outer circle with an opponent to their front and rear;

E) Having the referee start the game action by impelling an elongated molded diamond shaped object called the "horizontal", located in the center of the inner circle, at least one full revolution;

F) Starting a game clock to show the play time which starts the play;

G) Having a first player make their way into the inner circle, while the defensive team players try to stop their progress by bumping, tossing, holding and blocking said first player and the offensive team keeping the defensive team players out of the designated spinner's path;

H) Having the first player spin the "horizontal" and follow the agreed to rules of play;

I) Adding a plurality of weights to the Dazzle Bar and having the first player attempt to move the Dazzle bar to a designated position within an assigned area on the field;

J) Increasing the score of the offensive team by the agreed to rules of play if the first player is successful in moving the Dazzle bar to the designated position;

K) Switching from defensive to offensive teams by the agreed to rules of play;

L) Determining a winning team by the agreed to rules of play.

2. A sport game as described in claim 1 the referee stars by impelling an elongated molded diamond shaped object called the "horizontal", located in the center of the inner circle at least one full revolution, made on a mound atop and anchored, through structural means of a perforation cast with an upper end containing surface thread and slotted as a horizontal securing means to the top of the mound centered within an inner circle, centered with an outer circle and the mound further attaches to:

A) Plating molded rectangular and cast having perforations for fastening an upright post of metal or heavy duty plastic up to 42 inches in length;

B) Cast with passageways between 2½ to 12 inches inward of each end for fastening upright and plating via a cast high pressure tapering bolt of aluminum for the attachment of one main section that consist of;

C) 5 layers of cushion material 1½" thick, 8 sided in designed measuring 21½" by 24" on it broadest ends made with perforations for fitting reinforcements, cloth inserted disc, leather, etc. on top and bottom, pre cut aligning and fastening to layers and precast steel mounting bracket, item 26;

D) Having a passageway, item 25 fastening a main section and upright and said layers covered with precut reinforcement, neoprene rubber, vinyl, form, cloth, etc. to allow an elongated molded diamond shaped object called the "horizontal", located in the center of the inner circle a predetermined circular revolutionary path.

3. A method of playing a sport game in accordance with claim 1 comprising:

A) An apparatus players must utilize having the following indicia;
   1. having an alternative design
   2. said alternative design having a plurality of anchoring holes circa the base for additional enhancement of stabilization of the base in the game;

B) Providing a furtherance of variation to impel the elongated molded diamond shaped object, called the "horizontal," which can be played on limitless surfaces for the game of Dictionary Dazzle.

* * * * *